United States Patent [19]

Varon

[11] 4,316,547

[45] Feb. 23, 1982

[54] HANG RAIL SUPPORT AND HANG RAIL

[75] Inventor: David S. Varon, Highland Park, Ill.

[73] Assignee: Crown Metal Manufacturing Co., Chicago, Ill.

[21] Appl. No.: 130,572

[22] Filed: Mar. 14, 1980

[51] Int. Cl.[3] ..... A47H 1/02

[52] U.S. Cl. ..... 211/105.1; 211/124; 248/251

[58] Field of Search ..... 211/105.1, 105.3, 123, 211/124; 248/251; 403/346, 347; 16/2; 188/67

[56] References Cited

U.S. PATENT DOCUMENTS

| | | | |
|---|---|---|---|
| 3,229,026 | 1/1966 | Sulzer | 16/2 X |
| 3,920,208 | 11/1975 | Dowdy et al. | 403/347 X |
| 4,105,127 | 8/1978 | Holl | 211/124 |
| 4,150,753 | 4/1979 | Stahl et al. | 211/105.1 |

*Primary Examiner*—Ernest R. Purser

*Attorney, Agent, or Firm*—Silverman, Cass & Singer, Ltd.

[57] ABSTRACT

A hang rail support and bracket in which the hang rail is of rectangular cross section and is adapted to be supported in such a manner that other brackets may be secured along the length of the rail and have merchandise hung therefrom in cantilever fashion. The support and bracket is adapted to be secured to a vertical standard such as the conventional slotted ones and has a vertically extending notch having a U-shaped liner member or grommet of yieldable but firm material such as plastic seated in the notch. The throat of the liner member or grommet is of a size and configuration firmly to engage a rectangular cross section hang rail pressed into the grommet throat. Through the use of at least a pair of such brackets provided with notches and grommets the hang rail can be supported and prevented from rotating while resisting inadvertent removal and endwise sliding relative to the brackets.

7 Claims, 5 Drawing Figures

FIG. 2
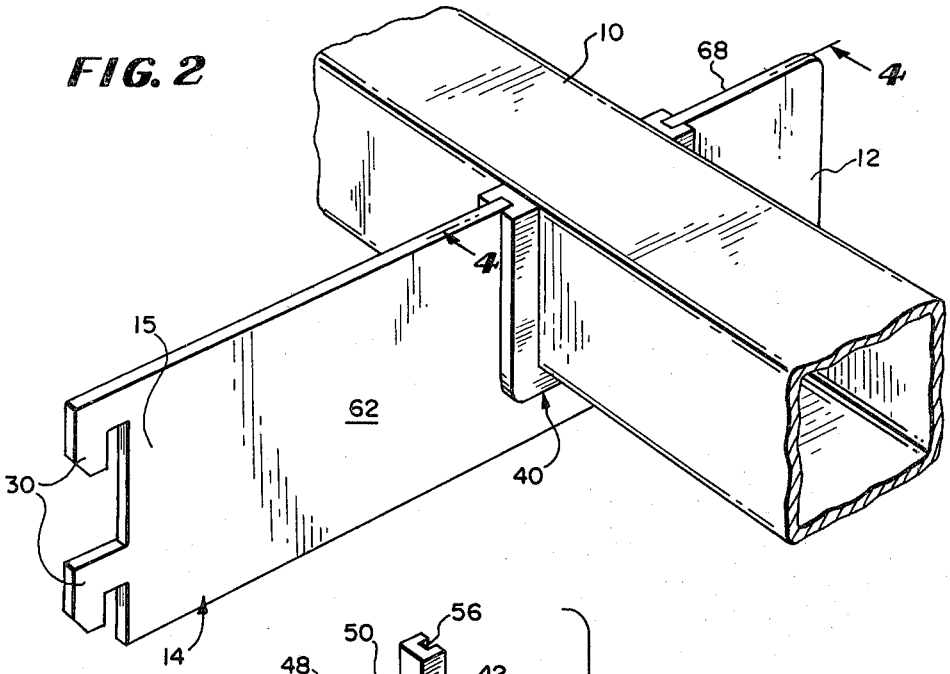
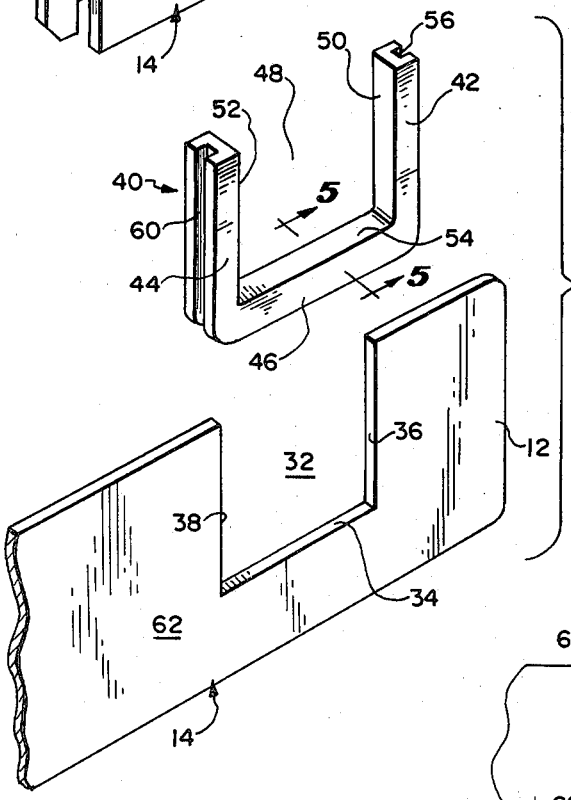
FIG. 3
FIG. 4
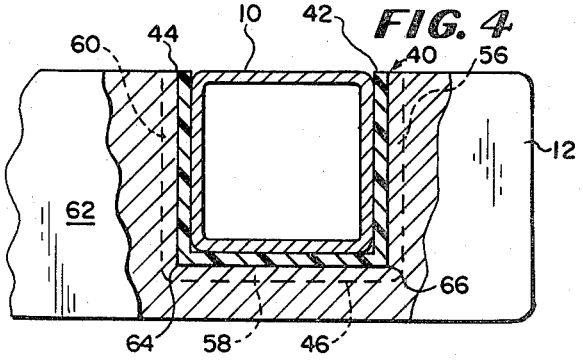
FIG 5
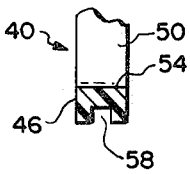

HANG RAIL SUPPORT AND HANG RAIL

BACKGROUND OF THE INVENTION

The invention herein is primarily concerned with the class of articles that are known as store fixtures but particularly is concerned with an assembly that is used for merchandizing clothing. No limitation is intended by this statement.

In U.S. Pat. No. 3,685,662 there is disclosed a merchandizing system primarily for clothing in which a pair of spaced brackets is mounted to the conventional slotted standards that can be secured to a wall; each has an adapter of special construction secured to its front end; and there is a hang rail of special construction extending between the adapters and supported by the brackets. It is intended that clothing items on hangers offered for sale or on display will be engaged onto the hang rail and be supported thereby to enable these items to be hung in orderly fashion while being capable of sliding movement along the rail to enable their viewing.

This type of structure is especially useful when the rail itself is to support the clothing items directly, but has less utility when it is desired to have a plurality of items arranged along a support, for example a short length of tubing, which extends forwardly from the rail such as in a plane normal thereto. Thus, in the process of examining articles of clothing that are mounted on a hang rail, the customer may wish to see a series of articles from different areas but wants to examine them closely in one place. The articles are gathered together and there may be short cantilever mounted rods secured to the wall and upon which the salesperson will hang the gathered articles.

It would be convenient to have the short cantilever mounted rods hung from the main hang rail and for this purpose it has been proposed to utilize rectangular cross section hang rods or horizontally disposed bars to mount the cantilever rods. In such cases, the cantilever rod has an inverted U-shaped member at its secured end which engages closely over the rectangular hang rail or bar. One such structure is disclosed in U.S. Pat. No. 4,150,753 wherein there is shown a merchandise display fixture based upon a pair of spaced brackets which are secured to a wall by means of slotted vertical standards or the like. Each bracket has a right angle bent portion at its distal end and a rearwardly extending reversely turned wing integral with the right angle bent portion. Aligned vertical slots in the main part of the bracket and the reversely turned wing receive the bar which is installed in a downward movement and the right angle bent portion has a cam button which engages the front face of the bar when it is installed so that the bar is frictionally engaged in the slots. The pressure of the cam button is intended to prevent inadvertent removal of the bar, lengthwise sliding during use and the notches are expected to keep the bar from rotating during use.

The invention herein is directed to a structure which obviates some of the disadvantages of the structure of said U.S. Pat. No. 4,150,753. The structures which are illustrated and described in said last-mentioned patent are complex in that they require complicated tools and dies for manufacture; they are wasteful of material because they require a bracket made from a metal member whose length is at least equal to the length of the bracket from rear to front plus the length of the right angle bent portion on the front end plus the length of the reverse turned wing.

The invention herein is directed to a structure which is simple, economical to manufacture and is highly effective to achieve the ends of providing for the support of a hang rail which is rectangular in cross section and which will not inadvertently move or twist when used for supporting merchandise, especially when said merchandise is carried by cantilever mounted rods mounted on the hang rail.

SUMMARY OF THE INVENTION

A hang rail support bracket and hang rail in which the bracket is to be supported at its proximal end from a vertical standard or the like and a rectangular hang rail or bar is in turn supported from the forward or distal end of the bracket for enabling merchandise to be hung from the rail or bar.

The bracket has a rectangular notch spaced rearwardly from the distal end thereof a dimension to receive a hang rail of rectangular cross section therein but with a U-shaped liner member or grommet disposed in the notch between the hang rail and the metal of the bracket. The U-shaped liner member or grommet is made out of a yieldable material such as firm plastic or a hard durometer elastomer and its throat is of such a dimension when installed such that there is an interference fit for the hang rail requiring that the hang rail be pushed into the throat of the grommet for seating. The result is that the hang rail is frictionally engaged in the notch and resists inadvertent removal, endwise sliding and rotation.

The notch is of a size and configuration greater than the hang rail by the thickness of the parts of the U-shaped liner member or grommet which is engaged in the notch, the liner member or grommet having an exterior groove on each of its bottom part and side arms to receive the metal edges and bottom of the notch.

BRIEF DESCRIPTION OF THE DRAWING

FIG. 2 is a fragmentary perspective view of a bracket constructed in accordance with the invention with a portion of the hang rail or bar being shown installed therein;

FIG. 3 is an exploded perspective view of the same but with the hang rail or bar not present;

FIG. 4 is a sectional view taken generally along the plane indicated by the line 4—4 of FIG. 2 and in the indicated direction; and FIG. 5 is a fragmentary sectional view taken through the liner member or grommet of FIG. 3 along the line 3—3 and in the indicated direction.

DESCRIPTION OF THE PREFERRED EMBODIMENT

Figure 1:
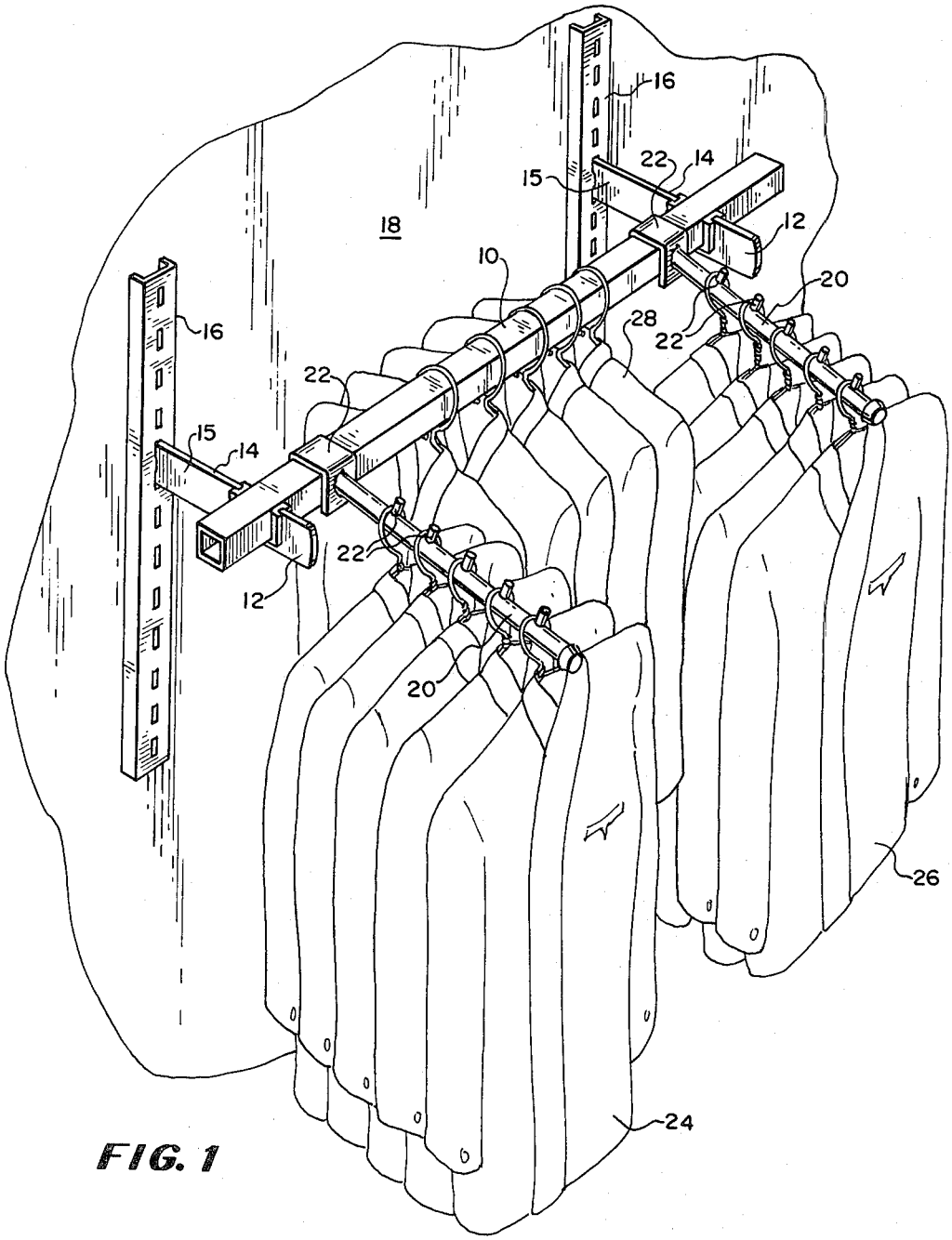
FIG. 1 is a perspective view of a square cross section hang rail or bar with cantilever rods shown attached thereto, the hang rail or bar being secured to standards by means of the bracket arrangement of the invention.

The invention herein comprises the bracket of the invention independently and the bracket in combination with a hang rail or bar of rectangular cross section.

In FIG. 1 there is illustrated an installation of a bracket and bar system according to the invention in which clothing is to be hung and displayed for example in a clothing store. The bar of the invention is shown at 10 mounted close to the distal ends 12 of two spaced brackets 14 whose proximal ends 15 are secured to slotted standards 16 connected to a vertical wall 18. In this case the bar is of square cross section and hollow but it is common to have solid bars and bars which are not square. Strap-like thin bars are used often and these are normally mounted with their long cross section arranged vertically.

In this instance merchandise rods 20 are provided with inverted U-shaped metal yokes 22 of such dimensions and configuration to fit over and upon the hang rail or bar 20 so that the rods 20 are cantilever mounted. The rods are provided with pins 22 so that garments on hangers may be mounted thereon for display and viewing. This is shown at 24 and 26 but in addition the hang rail 10 itself is capable of being used for supporting other garments on hangers for storage and display as indicated at 28.

The brackets 14 are constructed in accordance with the invention as will be detailed hereinafter, but it will become apparent that they could be made out of conventional brackets of this general type which are modified in accordance with the teachings of the invention. The hang rail or bar 10 per se is conventional as are the standards 16 and the rods 20.

The bracket 14 of the invention is shown in more detail in FIGS. 2 to 5 along with the square cross section hang rail or bar 10. The proximal end 15 of the bracket 14 is provided with the illustrated hooks 30 of more or less conventional construction so that the bracket may be supported as described from a conventional slotted standard 16, but any form of vertical support is feasible.

Close to the distal end 12 there is formed a rectangular notch 32 by punching, the notch having a bottom support edge 34 and front and rear support edges 36 and 38. The configuration of the notch 32 is the same as that of the hang rail or bar 10 which is to be seated therein but the dimensions are somewhat larger. For example, for a one inch square hang rail the dimension between the support edges 36 and 38 may be one and a quarter of an inch, more or less, and the depth of the notch 32 may be about one and an eighth inch. This allows an eighth of an inch on all of the support edges for the presence of the U-shaped liner member or grommet 40.

The U-shaped liner member or grommet 40 is preferably injection molded from synthetic resin such as dense polypropylene, vinyl or an elastomer. It is required to be relatively tough and yet yieldable so that it can act somewhat like packing or a gasket. If an elastomer, it should be of a relatively high durometer so as not to easily distort.

The liner member or grommet 40 is best seen in FIG. 3 and it is formed with side arms 42 and 44 which are bridged by a lower part 46. The interior of the liner or grommet is referred to herein as its throat 48 and the facing surfaces 50, 52 and 54 are flat to provide frictional engagement with the sides and bottom faces of the hang rail or bar 10 which is to be engaged into the throat 48. The outer surfaces of the U-shaped liner member or grommet are grooved in their centers along their longer dimensions, the resulting grooves being indicated at 56, 58 (FIGS. 4 and 5) and 60. The width of the grooves 56, 58 and 60 is the same as the thickness of the sheet metal from which the body 62 of the bracket 14 is formed or perhaps slightly less so that when installed in the notch 32 the liner or grommet 40 will seat firmly. The depth of the grooves 56, 58 and 60 is such that the distance between the bottoms of the grooves 56 and 60 is equal to the distance between the support edges 36 and 38.

Assuming the dimensions mentioned above, the distance between the grooves 56 and 60 would be about an inch and a quarter. The thickness of the material remaining in each of the arms 42 and 44 from the bottom of each groove to its flat surface 50 and 52, respectively, would be slightly greater than one eighth inch so that the hang rail or bar 10 will be firmly gripped between the surfaces 50 and 52.

The configuration of the grooves 56, 58 and 60 is such that they meet at squared corners as shown at 64 and 66 to tightly seat within the notch 32.

The U-shaped liner member or grommet 40 is installed by holding the same in the manner shown in FIG. 3 and then pressing the same into the notch 32 until firmly seated. Preferably the vertical dimensions of the notch 32 and the vertical arms 42 and 44 of the liner member or grommet 40 are such that when all is assembled and the hang rail or bar 10 is in place, the upper face of the bar 10 will be flush with the upper edge 68 of the bracket 14.

Variations are capable of being made without departing from the spirit or scope of the invention as defined in the appended claims.

What it is desired to secure by Letters Patent of the United States is:

1. A support assembly for merchandise and including a rectangular cross section hang rail or bar extending between and supported by spaced apart brackets, said hang rail or bar being subject to rotational force during use thereof and said support assembly serving to resist said force, said assembly including the hang rail or bar in combination with said brackets for supporting same, and each bracket comprising:

A. an elongate bracket body having a proximal end and a distal end, the proximal end having means to enable the bracket body to be mounted to a vertical support structure, B. said bracket body comprising a vertically arranged sheet metal member having an upper edge, the sheet member defining generally a vertical plane, C. a vertically extending notch formed in said bracket body spaced rearwardly from the distal end thereof, said notch having front and rear support edges and a bottom support edge and the notch opening to the upper edge of the bracket body, said notch also having substantially the same configuration as the cross sectional configuration of at least a substantial portion of the lower part of the hang rail or bar if not all of the cross sectional configuration of the bottom and side faces of said hang rail or bar but being somewhat larger than the hang rail or bar, D. an integral U-shaped liner member of firm but somewhat yieldable material engaged in the notch and having a pair of side arms engaged respectively to the front and rear support edges of the notch and a bottom connecting part engaged to the bottom support edge, the liner member presenting an upwardly opening throat formed of the interior surfaces of said side arms and bottom connecting part, the distance between said interior surfaces of said side arms being slightly less than the width of said hang rail or bar whereby there is interference with the hang rail or bar when the same is pressed into said throat thereby resisting frictional removal of the hang rail or bar and endwise movement thereof, each of said liner member side arms having a vertical groove in its exterior surface along the length of side arm and said front and rear support edges being respectively engaged in said grooves whereby to lock the liner member into said notch and E. the hang rail or bar engaged into said throat with its lower face resting on the interior surface of the bottom connecting part and its side faces frictionally engaging said interior surfaces of said side arms.

2. The combination as claimed in claim 1 in which each of said liner members has a flat interior surface facing the hang rail or bar.

3. The combination as claimed in claim 1 in which the bottom connecting part of the liner member has a horizontal groove in its exterior surface along the length thereof connecting with the other two grooves and the bottom support edge is engaged in said horizontal groove.

4. The combination as claimed in claim 1 in which the depth of the notch and the dimensions of the liner member are such that the hang rail or bar upper face is substantially flush with the upper edge of the sheet metal member.

5. A supporting bracket for a generally rectangular cross section hang rail or bar which is adapted to extend between at least two such brackets, said bracket comprising:

A. an elongate bracket body having a proximal end and a distal end, the proximal end having means to enable the bracket body to be mounted to a vertical support structure, B. said bracket body comprising a vertically arranged sheet metal member having an upper edge, the sheet metal member defining generally a vertical plane, C. a vertically extending notch formed in said bracket body spaced rearwardly from the distal end thereof, said notch having front and rear support edges and a bottom support edge and the notch opening to the upper edge of the bracket body, said notch also having substantially the same configuration as the cross sectional configuration of at least a substantial portion of of the lower part of a hang rail or bar adapted to be received in said notch but being somewhat larger than the hang rail or bar, D. an integral U-shaped liner member of firm but somewhat yieldable material engaged in the notch and having a pair of side arms engaged respectively to the front and rear support edges of the notch and a bottom connecting part engaged to the bottom support edge, the liner member presenting an upwardly opening throat formed of the interior surfaces of the side arms and bottom connecting part, the distance between the said interior surfaces of said side arms being slightly less than the width of said hang rail or bar which is adapted to be inserted into said throat whereby the liner member will interfere with said hang rail or bar when same is pressed into said throat thereby resisting frictional removal of the hang rail or bar and endwise movement thereof said liner member side arms having respective vertical grooves in its exterior surfaces along the lengths of the side arms and said front and rear support edges being respectively engaged in said grooves whereby to lock the liner member into said notch, and E. the hang rail or bar adapted to be received into said throat and engaged therein with its lower face resting on the interior of the bottom connecting part and its side faces frictionally engaging said interior surfaces of said side arms.

6. The bracket as claimed in claim 5 in which said liner member has flat interior surfaces facing the throat.

7. The bracket as claimed in claim 5 in which the bottom connecting part of the liner member has a horizontal groove in its exterior surface along the length thereof connecting with the other two grooves and the bottom support edge is engaged in the horizontal groove.

* * * * *